US011585570B1

(12) United States Patent
Galloway

(10) Patent No.: US 11,585,570 B1
(45) Date of Patent: Feb. 21, 2023

(54) WATER HEATER WITH GENERATOR

(71) Applicant: Jesse L. Galloway, Oak Grove, KY (US)

(72) Inventor: Jesse L. Galloway, Oak Grove, KY (US)

( * ) Notice: Subject to any disclaimer, the term of this patent is extended or adjusted under 35 U.S.C. 154(b) by 364 days.

(21) Appl. No.: 17/091,297

(22) Filed: Nov. 6, 2020

Related U.S. Application Data

(60) Provisional application No. 62/931,859, filed on Nov. 7, 2019.

(51) Int. Cl.
*F24H 1/12* (2022.01)
*H05B 1/02* (2006.01)
*H05B 3/00* (2006.01)

(52) U.S. Cl.
CPC ..... *F24H 1/121* (2013.01); *H05B 1/0297* (2013.01); *H05B 3/0042* (2013.01); *F05D 2210/11* (2013.01); *F05D 2220/64* (2013.01); *F05D 2220/76* (2013.01); *H05B 2203/021* (2013.01)

(58) Field of Classification Search
CPC ..... F24H 1/121; F24H 1/142; H05B 1/0297; H05B 1/269; H05B 1/283; H05B 3/0042; H05B 2203/021; F05D 2210/11; F05D 2220/64; F05D 2220/76
USPC ..... 392/471
See application file for complete search history.

(56) References Cited

U.S. PATENT DOCUMENTS

| | | | | |
|---|---|---|---|---|
| 4,369,373 | A * | 1/1983 | Wiseman | E21B 36/04 290/43 |
| 5,495,829 | A | 3/1996 | Jayaraman et al. | |
| 6,761,134 | B1 | 7/2004 | Trant | |
| 6,792,201 | B1 * | 9/2004 | Tsai | F24H 1/142 237/19 |
| 7,567,750 | B2 | 7/2009 | Yang | |
| 9,103,562 | B2 | 8/2015 | Nakagawa et al. | |
| 9,335,066 | B2 | 5/2016 | Humphrey et al. | |

* cited by examiner

*Primary Examiner* — Dana Ross
*Assistant Examiner* — Joe E Mills, Jr.
(74) *Attorney, Agent, or Firm* — Cramer Patent & Design, PLLC; Aaron R. Cramer

(57) ABSTRACT

Water heater with generator comprises a self-heating tankless water system comprising a length of tubing having a plurality of electrical heating cables secured about the piping. As cold water enters the system the flow of the water is diverted through an electrical generator which provides the electricity to heat the water.

20 Claims, 4 Drawing Sheets

WATER HEATER WITH GENERATOR

RELATED APPLICATIONS

The present invention is a continuation of U.S. Provisional Application No. 62/931,859 filed on Nov. 7, 2019, the entire disclosures of which are incorporated herein by reference.

FIELD OF THE INVENTION

The present invention relates generally to a water heater and more specifically to a water heater with a generator.

BACKGROUND OF THE INVENTION

With the recent hike in energy costs, many Americans are reexamining their home energy usage in an effort to save on the family budget. One (1) household appliance which many do not think about, but operates all day long, is the hot water heater. Whether electrically operated or gas-fired, these hot water heaters keep a large supply of water at a constant elevated temperature whether anyone is home or awake to use it or not.

Many users resort to the use of instantaneous water heaters that heat the water only as it is being used. While certainly functional, they still require a large amount of power. They also require an electrical power connection nearby wherever hot water is needed. Hot water is lost during any power failure. Accordingly, there exists a need for a means by which hot water can be generated without any operating cost or the disadvantages as described above. The use of the water heater allows users of hot water to harness the power of the moving water itself in a passive manner so that external energy usage is eliminated and money is saved in a much more effective manner than conventional water heaters.

SUMMARY OF THE INVENTION

The principles of the present invention provide for a water heater which has a generator that generates and utilizes electrical power to provide a heated water flow. The generator is driven by a turbine that has a plurality of impellers, each of the impellers are impinged by a cool water flow. The cool water flow contacts the impellers which drive the turbine of the generator to generate electrical power that is transferred to a heat exchanger element. The water heater also has a housing mounted within a structure where the heated water flow is delivered, a three-way valve which is actuated by a handle extending away from a side of the housing and a plurality of inlet tubing which extends away from the housing adjacent the three-way valve that enters the housing. The inlet tubing is downstream of the impellers and travels into a heat exchanger section and is attached to and in fluid communication with a plurality of heat exchanger tubing and output of the three-way valve then leaves the water heater as an outgoing hot water flow. The housing includes a heat exchanger portion within the housing located adjacent to the generator.

The water heater also has an interior tubing disposed downstream of the heat exchanger section. The interior tubing travels within the housing. The interior tubing is attached to and in fluid communication with a plurality of heat exchanger tubing. The water heater also has a plurality of outlet tubing disposed downstream of the interior tubing. The outlet tubing is attached to and in fluid communication with the interior tubing. The water heater also has a plurality of bypass tubing in fluid communication between the inlet tubing and the outlet tubing and wholly resides within the housing, a cold-water shutoff valve which is located in a plurality of incoming cold water and a second tee fitting which directs the incoming cold water directly to a point of use.

The heat exchanger element may be a heating element that generates heat due to electrical resistance. The heat exchanger element may be helically wound outside of the heat exchanger tubing. The heat exchanger element may be helically wound outside of the heat exchanger tubing and is a co-current-style of heat exchange. The cool water flow may enter a first tee fitting where one output flows to the three-way valve as the bypass water flow and the remaining output flows to the turbine. The housing may be mounted adjacent to a final delivery location of the heated water flow. Output from the turbine may flow to the heat exchanger section as an input, whereupon it may be heated and the output of the heat exchanger section may then flow to the remaining input of the three-way valve, where it is tempered by manipulation of the handle.

The inlet tubing may be configured to be in fluid communication with a water source to convey the cool water flow from the water source to the generator. The inlet tubing and the heat exchanger tubing may be continuous and the delineation between the inlet tubing and the heat exchanger tubing which may occur at the heat exchanger section. The inlet tubing and the heat exchanger tubing may be identical and the delineation between the inlet tubing and the heat exchanger tubing occurs at the heat exchanger section. The heat exchanger element may be brought into contact along its entire length with the heat exchanger tubing.

The heat exchanger tubing may be a continuous length of switchbacks. The heat exchanger tubing may be a continuous length of loops. The cool water flow may transform to the heated water flow at the exit of the heat exchanger section. The interior tubing and the heat exchanger tubing may be continuous and the delineation between the interior tubing and the heat exchanger tubing may occur at the heat exchanger section. The interior tubing and the heat exchanger tubing is identical and the delineation between the interior tubing and the heat exchanger tubing occurs at the heat exchanger section.

The outlet tubing may travel out of and extending away from the housing to be in fluid communication with a delivery source to convey the heated water flow thereto. The delivery source may be selected from the group consisting of a sink, a shower, or a bathtub. The three-way valve may be in fluid communication with the bypass tubing in order to meter cool water flow into the outlet tubing to mix with the heated water flow to provide more metered and balanced temperature of the delivered water. The point of use may be selected from the group consisting of a sink, a shower, or a washing machine.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
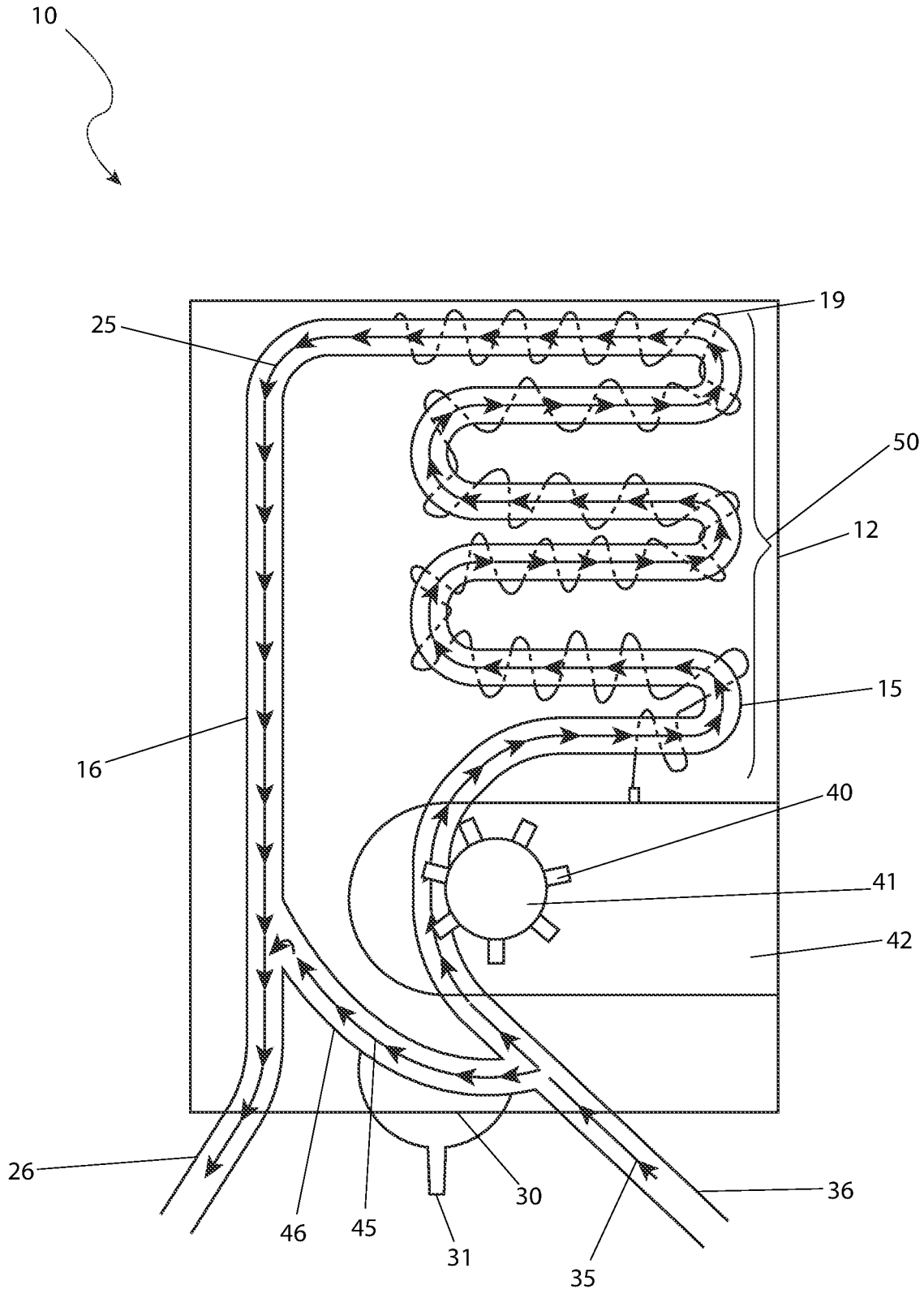
FIG. 1 is a diagrammatic view of the water heater, shown in a utilized state, according to the preferred embodiment of the present invention.

10 water heater
12 housing
15 heat exchanger tubing
16 interior tubing
19 heat exchanger element
25 heated water flow
26 outlet tubing
30 three-way valve
31 handle
35 cool water flow
36 inlet tubing
40 impeller
41 turbine
42 generator
45 bypass water flow
46 bypass
50 heat exchanger section
55 incoming cold water
60 first tee fitting
65 outgoing hot water
70 cold water shutoff valve
75 second tee fitting
80 point of use
90 rotational energy "r"
95 interconnecting wiring

DESCRIPTION OF THE PREFERRED EMBODIMENT

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figure

Referring now to FIG. 1, a diagrammatic view of a water heater 10, which has a generator 42 that generates and utilizes electrical power to provide a heated water flow 25 from an incoming cool water flow 35 within a heat exchanger portion 50 of a housing 12. The housing 12 can be mounted on a vertical or horizontal location and be located either central within a structure where the heated water flow 25 is delivered, or adjacent to a final delivery location of the heated water flow 25. As such, the housing 12 and heat exchanger section 50 may be sized according to the desired service as mentioned above.

Located within the housing 12 is a heat exchanger portion 50 located immediately adjacent to a generator 42. Extending away from a side of the housing 12 is a three-way valve 30 that is actuated by a handle 31. Inlet tubing 36 is provided that extends away from the housing 12 adjacent the three-way valve 30 and enters the housing 12. The inlet tubing 36 is configured to be in fluid communication with a water source to convey a cool water flow 35 from the water source to the generator 42. The generator 42 is driven by a turbine 41 that has a plurality of impellers 40, each of which are impinged by the cool water flow 35. As such, the cool water flow 35 contacts the impellers 40 which drive the turbine 41 of the generator 42 to generate electrical power. The inlet tubing 36 downstream of the impellers 40 travels into the heat exchanger section 50 and is attached to and in fluid communication with heat exchanger tubing 15. In other embodiments, the inlet tubing 36 and heat exchanger tubing 15 are continuous or identical and the delineation between the inlet tubing 36 and heat exchanger tubing 15 occurs at the heat exchanger section 50.

Electrical power generated by the generator 42 is transferred to a heat exchanger element 19, which is preferably a typical heating element that generates heat due to electrical resistance. The heat exchanger element 19 is brought into contact along its entire length with the heat exchanger tubing 15. The heat exchanger tubing 15 is preferably a continuous length of switchbacks or loops, and the heat exchanger element 19 is preferably helically wound about the exterior of the heat exchanger tubing 15. As such, the heat exchanger section 50 is a co-current-style of heat exchange. The rating of the heat exchanger element 19, the size and amount of switchbacks of the heat exchanger tubing 15 is dependent on the flow rate of the cool water flow 35, and the desired exit temperature of the heated water flow 25. The cool water flow 35 transforms to the heated water flow 25 at the exit of the heat exchanger section 50.

Interior tubing 16 downstream of the heat exchanger section 50 travels within the housing 12. The interior tubing 16 is attached to and in fluid communication with heat exchanger tubing 15. In other embodiments, the interior tubing 16 and heat exchanger tubing 15 are continuous or identical and the delineation between the interior tubing 16 and heat exchanger tubing 15 occurs at the heat exchanger section 50. Outlet tubing 26 is located downstream of the interior tubing 16 and travels out of and extending away from the housing 12 to be in fluid communication with a delivery source, such as a sink, shower, bathtub, etc. in order to convey the heated water flow 25 thereto. The outlet tubing 26 is attached to and in fluid communication with the interior tubing 16. In other embodiments, the outlet tubing 26 and interior tubing 16 are continuous or identical.

Bypass tubing 46 is in fluid communication between the inlet tubing 36 and the outlet tubing 26 and wholly resides within the housing 12. The three-way valve 30 is in fluid communication with the bypass tubing 30 in order to meter cool water flow 35 into the outlet tubing 26 to mix with the heated water flow 25 to provide more metered and balanced temperature of the delivered water.

Figure 2:
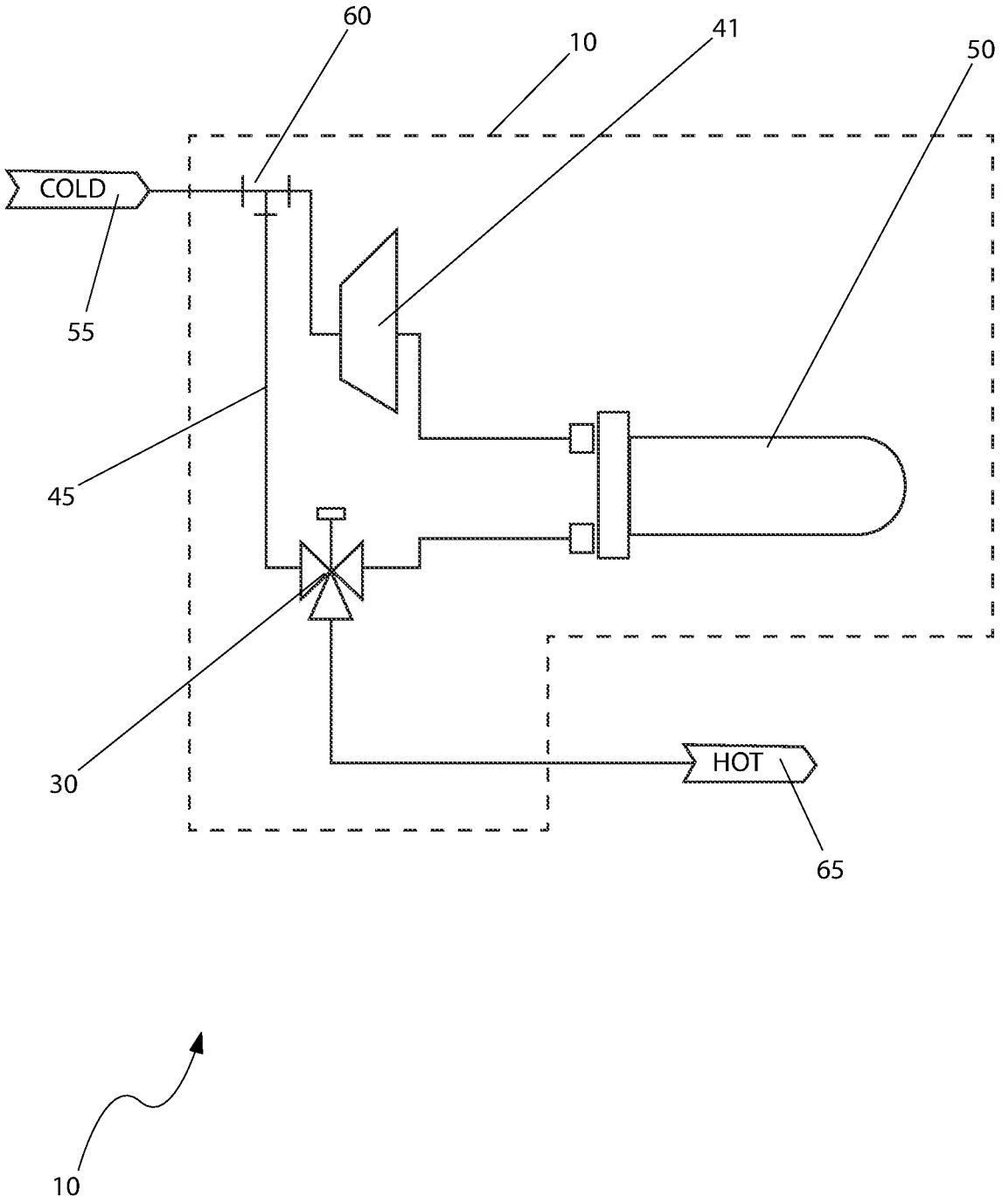
FIG. 2 is a process flow diagram of a water heater, according to the preferred embodiment of the present invention.

Referring next to FIG. 2, a process flow diagram of a water heater 10, according to the preferred embodiment of the present invention is disclosed. Incoming cold water 55 is provided from a well, municipal water source, water collection system, or the like. The cool water flow 35 enters a first tee fitting 60 where one output flows to the three-way valve 30 as the bypass water flow 45, and the remaining output flows to the turbine 41. The output from the turbine 41 flows to the heat exchanger section 50 as an input, whereupon it is heated as aforementioned described. The output of the heat exchanger section 50 then flows to the remaining input of the three-way valve 30, where it may be tempered as desired by the user by manipulation of the handle 31. The output of the three-way valve 30 then leaves the water heater 10 as an outgoing hot water 65 flow.

Figure 3:
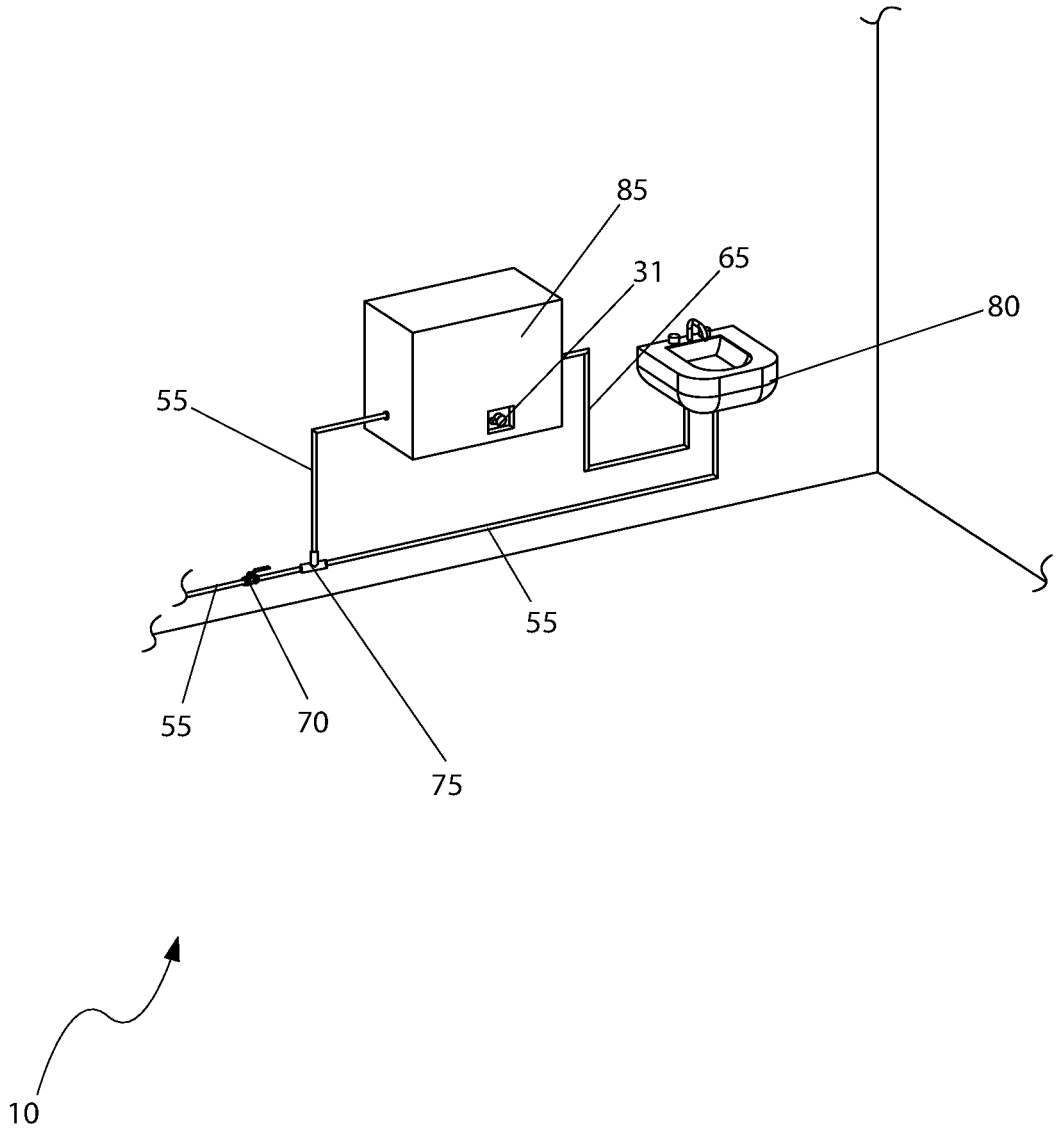
FIG. 3 is an environmental view of a water heater, according to the preferred embodiment of the present invention.

Referring now to FIG. 3, an environmental view of a water heater 10, according to the preferred embodiment of the present invention is depicted. A cold-water shutoff valve 70 may or may not be located in the incoming cold water 55. A second tee fitting 75 directs the incoming cold water 55 directly to a point of use 80 such as a sink (as shown), shower, washing machine, or the like. The exact configuration of the point of use 80 as used with the present invention is not intended to be a limiting factor of the present invention. The other side of the second tee fitting 75 flows to a housing 12 which houses the internal components of the water heater 10 as identified in FIG. 2. The handle 31 is exposed on the housing 12 to allow for user selection of the outgoing hot water 65 to their preference and/or the desired input parameters of the point of use 80. The outgoing hot water 65 is then routed to the point of use 80 in a conventional manner. Other variations on the environment view, such as additional cutoff valves, bypass valves, additional point of use 80 or the like are easily envisioned by those skilled in the art of commercial and residential plumbing installations and are intended to be within the scope of the present invention.

Figure 4:
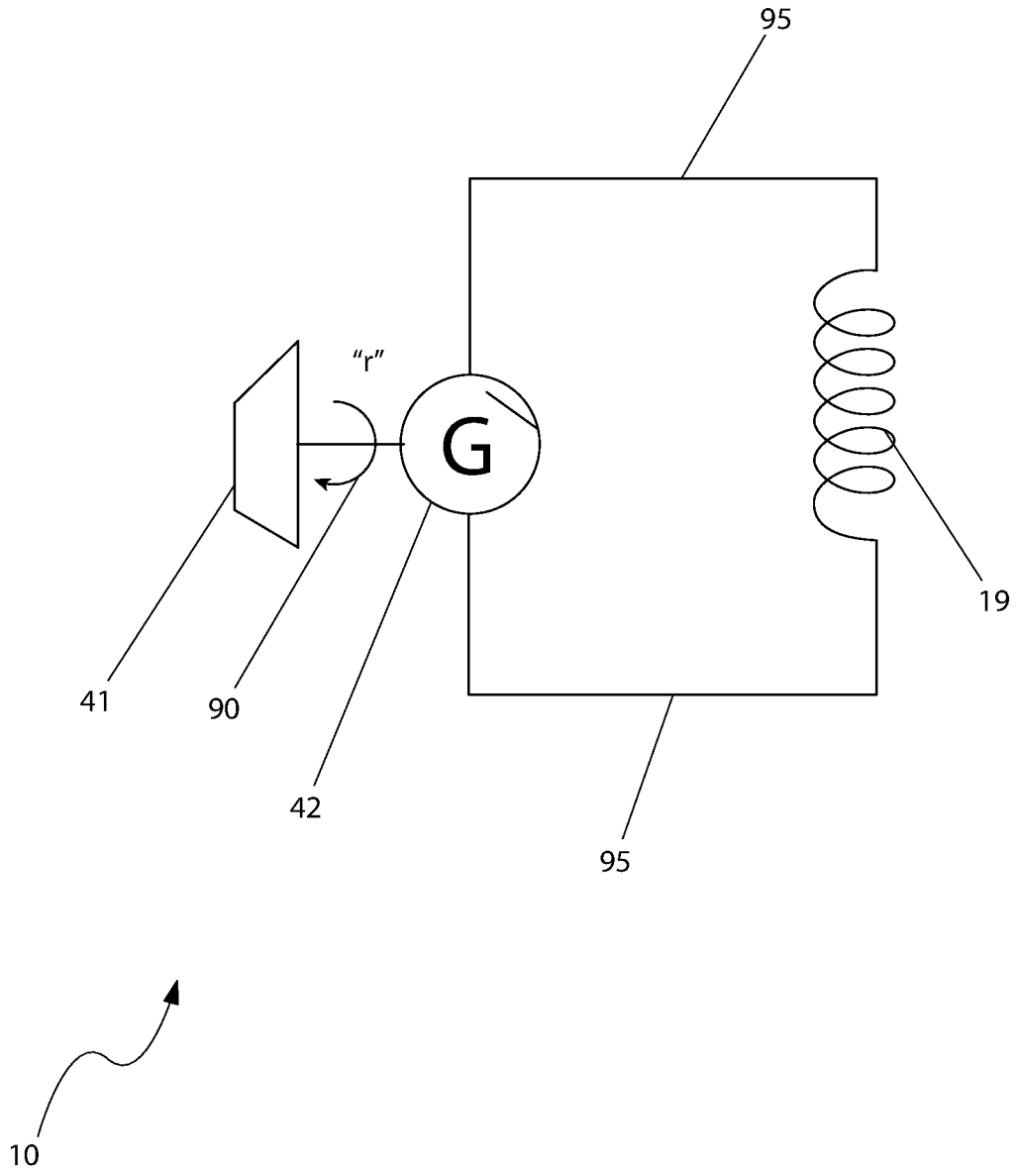
FIG. 4 is an electrical block diagram of the electrical components used in the water heater, according to the preferred embodiment of the present invention.

Referring to FIG. 4, an electrical block diagram of the electrical components used in the water heater 10, according to the preferred embodiment of the present invention is shown. The turbine 41 is rotated by the flow of cool water flow 35 (as shown in FIG. 1). Rotational energy "r" 90, as generated by the turbine 41 is then imparted to the generator 42. Electrical energy is then carried by interconnecting wiring 95 to the heat exchanger element 19 which heats the cool water flow 35 into outgoing hot water 65 (as shown in FIG. 2).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A water heater, comprising:

a generator that generates and utilizes electrical power to provide a heated water flow, the generator is driven by a turbine that has a plurality of impellers, each of the impellers are impinged by a cool water flow, the cool water flow contacts the impellers which drive the turbine of the generator to generate electrical power that is transferred to a heat exchanger element;

a housing mounted within a structure where the heated water flow is delivered, the housing includes a heat exchanger portion within the housing located adjacent to the generator;

a three-way valve actuated by a handle extending away from a side of the housing;

a plurality of inlet tubing extending away from the housing adjacent the three-way valve that enters the housing, the inlet tubing is downstream of the impellers and travels into a heat exchanger section and is attached to and in fluid communication with a plurality of heat exchanger tubing and output of the three-way valve then leaves the water heater as an outgoing hot water flow;

an interior tubing disposed downstream of the heat exchanger section, the interior tubing travels within the housing, the interior tubing is attached to and in fluid communication with a plurality of heat exchanger tubing;

a plurality of outlet tubing disposed downstream of the interior tubing, the outlet tubing is attached to and in fluid communication with the interior tubing;

a plurality of bypass tubing in fluid communication between the inlet tubing and the outlet tubing and wholly resides within the housing;

a cold-water shutoff valve located in a plurality of incoming cold water; and a second tee fitting directing the incoming cold water directly to a point of use.

2. The water heater, according to claim 1, wherein the heat exchanger element is a heating element that generates heat due to electrical resistance.

3. The water heater, according to claim 2, wherein the heat exchanger element is helically wound outside of the heat exchanger tubing.

4. The water heater, according to claim 3, wherein the heat exchanger element is helically wound outside of the heat exchanger tubing and is a co-current-style of heat exchange.

5. The water heater, according to claim 1, wherein the cool water flow enters a first tee fitting where one output flows to the three-way valve as the bypass water flow and the remaining output flows to the turbine.

6. The water heater, according to claim 1, wherein the housing mounted is adjacent to a final delivery location of the heated water flow.

7. The water heater, according to claim 1, wherein output from the turbine flows to the heat exchanger section as an input, whereupon it is heated and the output of the heat exchanger section then flows to the remaining input of the three-way valve, where it is tempered by manipulation of the handle.

8. The water heater, according to claim 1, wherein the inlet tubing is configured to be in fluid communication with a water source to convey the cool water flow from the water source to the generator.

9. The water heater, according to claim 1, wherein the inlet tubing and the heat exchanger tubing are continuous and the delineation between the inlet tubing and the heat exchanger tubing occurs at the heat exchanger section.

10. The water heater, according to claim 1, wherein the inlet tubing and the heat exchanger tubing is identical and the delineation between the inlet tubing and the heat exchanger tubing occurs at the heat exchanger section.

11. The water heater, according to claim 1, wherein the heat exchanger element is brought into contact along its entire length with the heat exchanger tubing.

12. The water heater, according to claim 1, wherein the heat exchanger tubing is a continuous length of switchbacks.

13. The water heater, according to claim 1, wherein the heat exchanger tubing is a continuous length of loops.

14. The water heater, according to claim 1, wherein the cool water flow transforms to the heated water flow at the exit of the heat exchanger section.

15. The water heater, according to claim 1, wherein the interior tubing and the heat exchanger tubing are continuous and the delineation between the interior tubing and the heat exchanger tubing occurs at the heat exchanger section.

16. The water heater, according to claim 1, wherein the interior tubing and the heat exchanger tubing is identical and the delineation between the interior tubing and the heat exchanger tubing occurs at the heat exchanger section.

17. The water heater, according to claim 1, wherein the outlet tubing travels out of and extending away from the housing to be in fluid communication with a delivery source to convey the heated water flow thereto.

18. The water heater, according to claim 17, wherein the delivery source is selected from the group consisting of a sink, a shower, or a bathtub.

19. The water heater, according to claim 1, wherein the three-way valve is in fluid communication with the bypass tubing in order to meter cool water flow into the outlet tubing to mix with the heated water flow to provide more metered and balanced temperature of the delivered water.

20. The water heater, according to claim 1, wherein the point of use is selected from the group consisting of a sink, a shower, or a washing machine.

* * * * *